United States Patent [19]

McBride

[11] 4,254,994

[45] Mar. 10, 1981

[54] METHOD OF AN APPARATUS FOR GAINING ACCESS TO AN UNDERGROUND CHAMBER

[75] Inventor: Donald J. McBride, Denville, N.J.

[73] Assignee: New Jersey Drilling Co., Inc., Netcong, N.J.

[21] Appl. No.: 913,547

[22] Filed: Jun. 8, 1978

[51] Int. Cl.[3] ..... E21F 11/00

[52] U.S. Cl. ..... 299/12; 175/96; 175/219; 405/133; 405/144

[58] Field of Search ..... 175/219, 85, 96, 97, 175/77; 299/12, 58; 405/133, 189, 192, 194, 144; 85/DIG. 1; 166/50; 175/77; 52/20

[56] References Cited

U.S. PATENT DOCUMENTS

| | | | |
|---|---|---|---|
| 1,819,918 | 8/1931 | Olson | 405/189 |
| 1,866,438 | 7/1932 | Williamson | 405/192 |
| 2,534,480 | 12/1950 | Shannon | 405/194 |
| 3,237,990 | 3/1966 | Robbins et al. | 175/86 X |
| 3,277,766 | 10/1966 | Burkdoll | 85/DIG. 1 |
| 3,382,002 | 5/1968 | Tabor | 299/31 |
| 3,402,967 | 9/1968 | Edmonds et al. | 175/77 |
| 3,593,811 | 7/1971 | Tedow | 175/97 |

FOREIGN PATENT DOCUMENTS

| | | | |
|---|---|---|---|
| 314913 | 11/1971 | U.S.S.R. | 299/12 |
| 420791 | 8/1974 | U.S.S.R. | 299/12 |

OTHER PUBLICATIONS

"Bore Hole Rescue Systems", *Mining Congress Journal,* Nov., 1978.

*Primary Examiner*—William F. Pate, III
*Attorney, Agent, or Firm*—Carella, Bain, Gilfillan & Rhodes

[57] ABSTRACT

Method and apparatus for gaining access to an underground chamber is disclosed to utilize a pressurized pipe casing which defines a conduit for introducing compressed air to a drill, which drill is utilized to bore a rescue hole to an area of entrapped miners. Thereafter, access is gained to the area of entrapment and the drill pipe is utilized as casing defining a rescue shaft for providing ingress of rescue personnel and egress of entrapped miners.

11 Claims, 7 Drawing Figures

METHOD OF AN APPARATUS FOR GAINING ACCESS TO AN UNDERGROUND CHAMBER

BACKGROUND OF THE DISCLOSURE

This invention relates to mine safety equipment. More specifically, this invention relates to a method of and apparatus for constructing an escape shaft through which miners, otherwise trapped below the surface of the earth in mine shafts, tunnels or underground rooms, may be rescued.

How often is it that the newspapers have carried heart rending stories of miners, trapped in underground caverns by reason of explosion, flooding or similar reasons, and the frantic efforts being made to locate and rescue them? Even more disturbingly, how often is it that after days and weeks of search and rescue attempts, announcements are made that the rescue attempt was unsuccessful, the mine will be sealed and the miners entombed forever? The only answer to these questions is a single answer—all too frequently.

The problems attendant to rescuing miners trapped underground as a result of a mine emergency are legion. The first problem to be dealt with, of course, is locating the miners. Where were they in the mine when the emergency occurred? Would miners have been forced to move in order to escape immediate danger such as gas or flooding? Assuming that logical approaches can be taken with respect to these questions and a likely location of their wherebouts in the mine identified, where is this point in the mine with respect to a surface location in order that drilling may be commenced to establish communication with the trapped miners and ultimately to provide an escape route?

Each of the foregoing questions must be answered before significant on-site rescue operations may commence. They are significant in the consideration of the background relating to the present invention by reason of the fact that the development of responsive information to the issues which they present is time-consuming and a great deal of time is the one thing which mine rescue personnel do not have.

As will be recognized by those skilled in these procedures, once the likely location of the trapped miners has been identified and an appropriate point for the commencement of drilling in order to reach their location has been identified, drilling equipment and support equipment are positioned and the drilling of probe holes is commenced.

The purpose of the probe holes is to establish a relatively small diameter but adequate shaft through which to establish communication with the trapped miners, to provide ventilation air as required to the trapped miners and, if necessary, to provide basic essentials such as food, additional clothing, medical supplies and the like.

Once a probe hole has been drilled, it has been determined that the trapped miners are in the location suspected and their basic and immediate needs accommodated to the extent possible, immediate steps are taken to commence the drilling of an escape shaft. It is to the equipment for drilling, constructing and utilizing such an escape shaft that the present invention is addressed.

Those familiar with these arts will recognize quickly that the known prior art equipment for effecting a rescue once the location of miners has been determined has been woefully inadequate. Two fundamental approaches have been taken; the drilling of a bare-walled shaft to the site of the miners' entrapment and the construction of a lined shaft.

Utilization of the former approach has been found to be unacceptable not only in the industry but also to the Bureau of Mine Safety because the construction of such a bare-walled shaft creates as many problems as it solves. More specifically, the construction of a bare-walled shaft, i.e. merely drilling a hole down through the surface of the earth, gives rise to the possibility that the drilling of the escape shaft itself may result in flooding, may result in the introduction of toxic gasses to the place of entrapment of the miners or may otherwise give rise to conditions which are equally as dangerous if not more so than the conditions to which the miners are being subjected prior to rescue. Thus, the Bureau of Mine Safety and the industry has recognized that although the construction of a lined shaft takes more time than the construction of a bare-walled shaft, the reduction in the likelihood of creating additional emergency situations is of such significance and importance that the additional time taken to effect a rescue is deemed to be justifiable.

Such time, however, can be as much as an additional 24 hours added to the rescue mission. The attendant necessity of removing drill pipe from the drilled hole and thereafter lining the hole with casing is difficult, time consuming and often fatal. Thus, access to the area of entrapment for purposes of ventilating, dewatering, physical access and the like without the necessity for removing drill pipe and still without losing the benefit of a lined shaft is of primary importance and has heretofore not been achieved in these arts.

SUMMARY OF THE INVENTION

It is an object of the present invention, therefore, to provide apparatus for gaining access to such an underground chamber which apparatus includes drill pipe which may be utilized as an escape shaft from an area of entrapment to the earth's surface.

Another object of the present invention is to provide apparatus for gaining access to an underground chamber wherein the drill for boring the rescue shaft is a pneumatic drill and the drill pipe itself constitutes the pipe line for compressed air for driving the drill.

Yet another object of the present invention is to provide a rescue shaft defined by casing contained within a drill hole wherein the drill hole casing comprises drill pipe thereby eliminating the necessity for removing drill pipe and thereafter installing casing liner.

Yet a further object of the present invention is to provide apparatus for gaining access to an underground chamber wherein a section of drill pipe is provided with a hatch for permitting selective communication between the interior of the drill pipe and the exterior of the drill pipe.

These and other objects are achieved by the present invention, one embodiment of apparatus of which includes a drill means for drilling a hole in the earth from the earth's surface to the desired underground location, drill pipe means extending from the drill means through the hole to the surface of the earth, the interior of the drill pipe means defining a personnel passage and means for placing the personnel passage in communication with the underground area such as to permit passage of personnel between the personnel passage and the underground area.

A method of obtaining access to an underground chamber according to the present invention may include the steps of drilling a shaft in the earth from the earth'surface to and through the location of the underground chamber through the use of a drill means mounted on a drill pipe, passing an individual through the drill pipe to the interior of the drill pipe immediately above the drill means, and establishing an opening between the interior of said drill pipe and said chamber such as to permit ingress and egress thereform.

BRIEF DESCRIPTION OF THE DRAWINGS

A more complete understanding of the present invention may be had from the following detailed description thereof, particularly when read in the light of the accompanying drawings wherein.

DETAILED DESCRIPTION

This invention relates to mine safety equipment. More particularly, this invention relates to apparatus for rescuing miners who may be trapped below the surface of the earth as a result of a mine explosion, flooding or some other such mine catastrophe.

Figure 1:
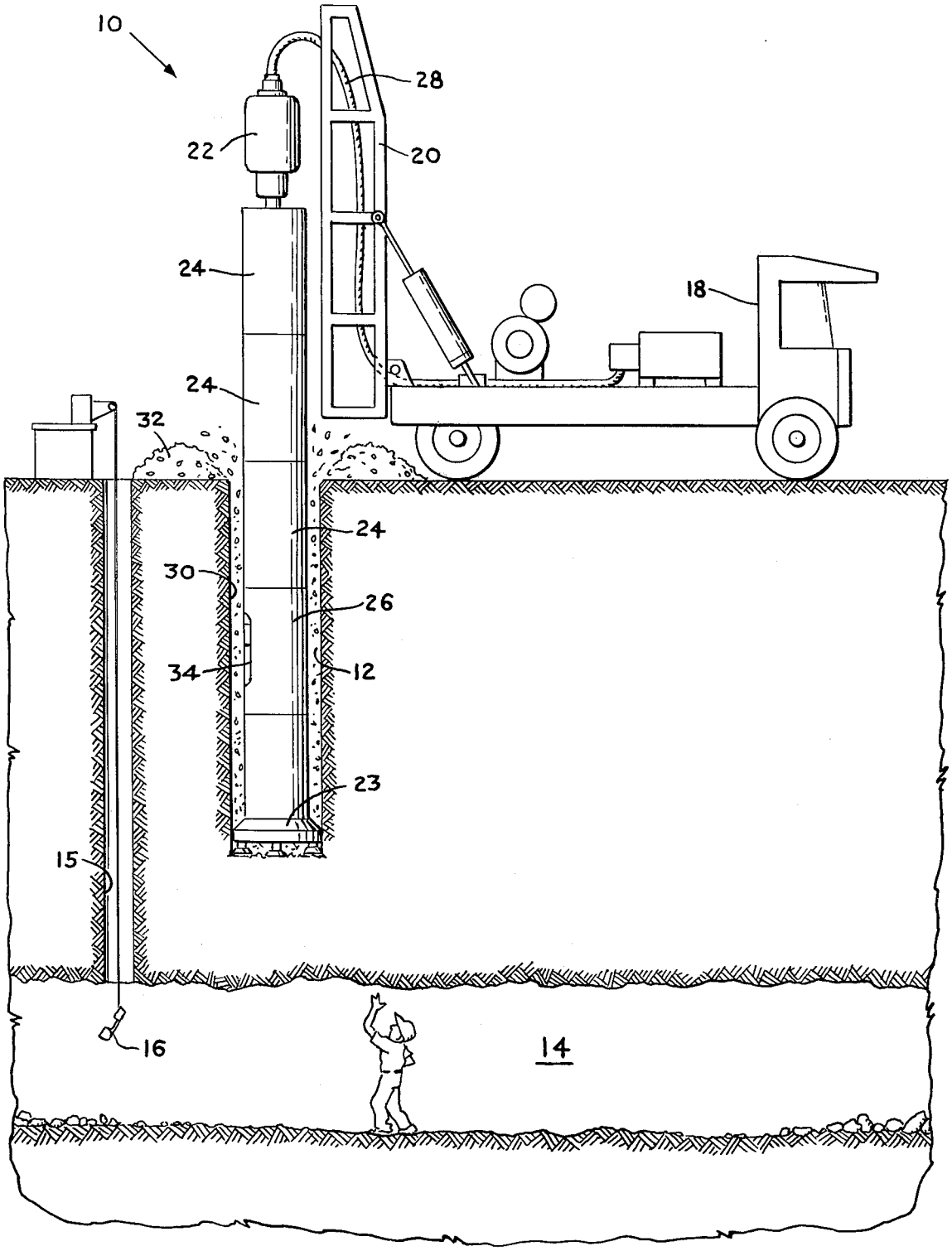
FIG. 1 is a schematic view of apparatus according to the present invention in the process of drilling a rescue shaft in accordance with the method of the present invention.
Figure 2:
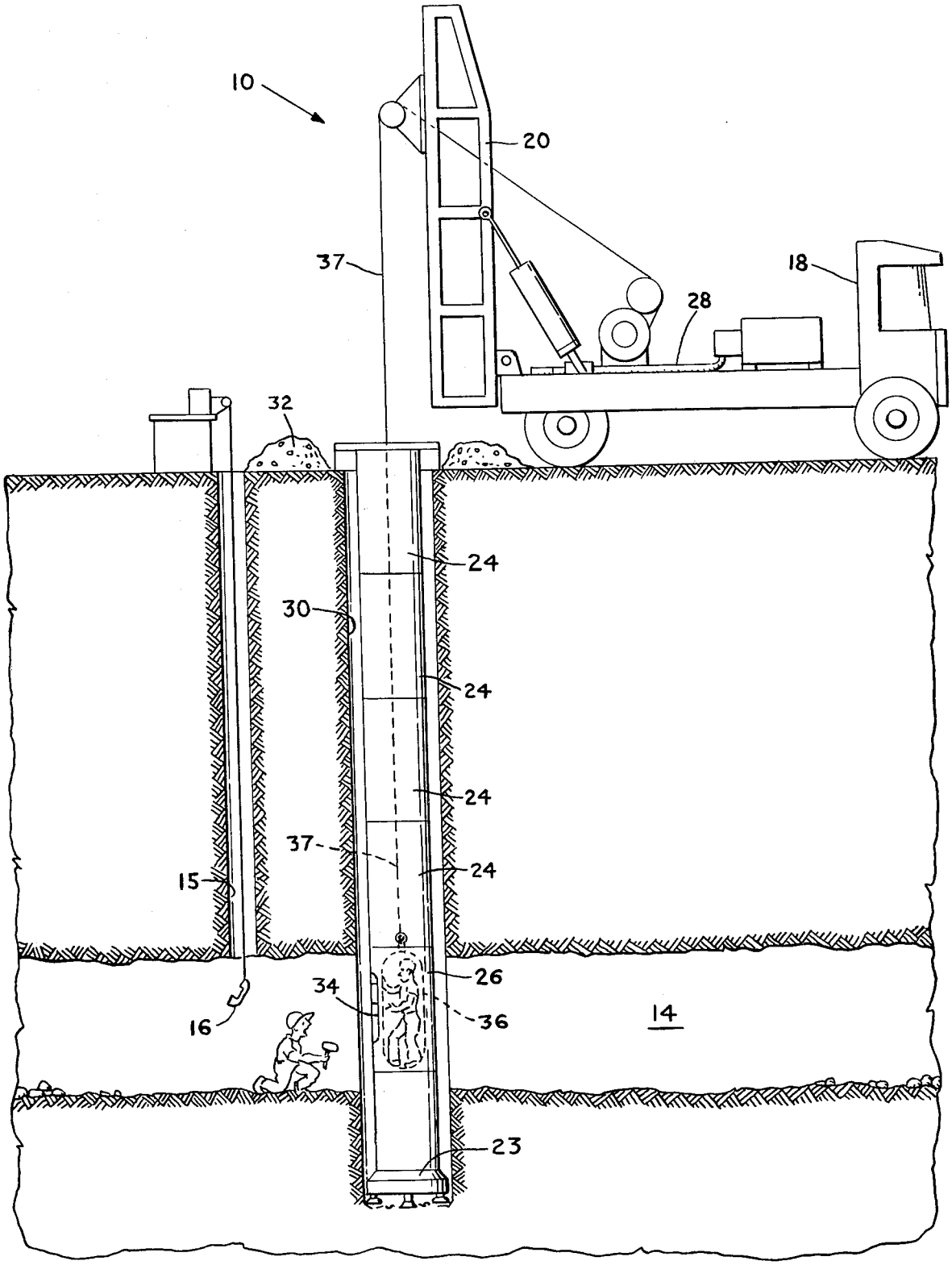
FIG. 2 is a view similar to FIG. 1 but showing the rescue apparatus according to the invention in position for effecting communication between the interior of the drill pipe and the underground chamber.

Referring to the drawings, and in particular FIGS. 1 and 2, apparatus structured in accordance with the present invention for rescuing miners is shown in these FIGURES and designated generally by the reference numeral 10. In FIG. 1 the apparatus is shown being utilized to drill an escape hole 12 toward a mine location 14 in which one or more miners may be trapped. In this regard, the location of the trapped miners has been verified through the use of a probe hole 15 through which may be provided communication means 16 as well as certain other fundamental necessities such as limited ventilation and food.

The mine rescue apparatus as shown in FIGS. 1 and 2, i.e. apparatus 10, can be seen to comprise a crane carrier 18 which provides mobility and support for a drill support tower 20.

Drill support tower 20 includes vertical support and vertical advance and retraction structure for a rotary drill head 22. As will be recognized by those skilled in these arts, rotary drill head 22 provides support for a drill 23, a plurality of drill pipe sections 24 and a rescue drill pipe section 26 structured in accordance with the teaching of the present invention.

Drill 23 may be any of the many heavy duty drills known in these arts for drilling holes of the desired diameters. It has been found, however, that a MAGNUM DRILL as marketed by the Ingersoll-Rand Company is of particular utility in boring a rescue hole of desired diameter, e.g. 30 inches.

Compressed air for powering the drill 23 is introduced into the drilling system through a line 28 which communicates rotary drill head 22 with a source of compressed air (not shown). In this regard, compressors capable of providing air in such quantities, e.g. 2400 cfm, are generally available in these fields.

Compressed air provided through line 28 is introduced into the drill pipe sections 24 through rotary drill head 22, drives drill 23 and is discharged therefrom.

The outer surfaces of drill 23, rescue drill pipe section 26 and drill pipe sections 24 cooperate with the internal surface of escape hole 12 to define an annular chamber 30. Air exhausting from drill 23 passes upwardly through annular chamber 30 and carries with it cuttings 32 which are thus removed from the escape hole.

As will be recognized by those skilled in these arts, there has been eliminated from the drilling structure according to the invention the usual compressed air line which ordinarily would run from rotary drill head 22 to a suitable fitting on the upper surface of drill 23. Rather, in the present invention, the drill casing defined by drill pipe sections 24 and rescue drill pipe section 26 is structured such as to be air-tight whereby to cause the entire drill casing to become the supply pipe for compressed air to operate drill 23. As is discussed in greater detail below, the elimination of the ordinarily provided compressed air line precludes the necessity for disasembly of such line prior to the introduction of an escape vehicle which may be dropped downwardly through the bore casing to effect rescue of the trapped miners.

Rescue drill pipe section 26 is provided with a removable door element 34, the particular structure of which is discussed below in detail. Thus, when drilling to the desired depth is achieved, i.e. as shown in FIG. 2, drill head 22 is disconnected from drill pipe sections 24 and the interior of the bore casing is opened such as to permit the introduction therethrough of a suitable rescue capsule 36. The rescue capsule 36 is lowered by the crane device on suitable cables 37 to a position where it is adjacent door 34 in rescue drill pipe section 26. At this time a rescue worker who is riding within the rescue capsule removes door 34 in rescue drill pipe section 26 thus gaining access to the site 14 of the entrapped miners. With such communication now achieved, miners may be placed in the rescue capsule 36 and brought to the surface without further event.

Rescue capsule 36 may be any of those generally known which will be accommodated within the bore casing. In this regard, a capsule known as the Dahlbusch Bomb has been considered and found to be satisfactory for present purposes.

Referring therefore to FIGS. 3 through 6, there is shown in greater detail a rescue drill pipe section 26 structured in accordance with the invention.

Figure 3:
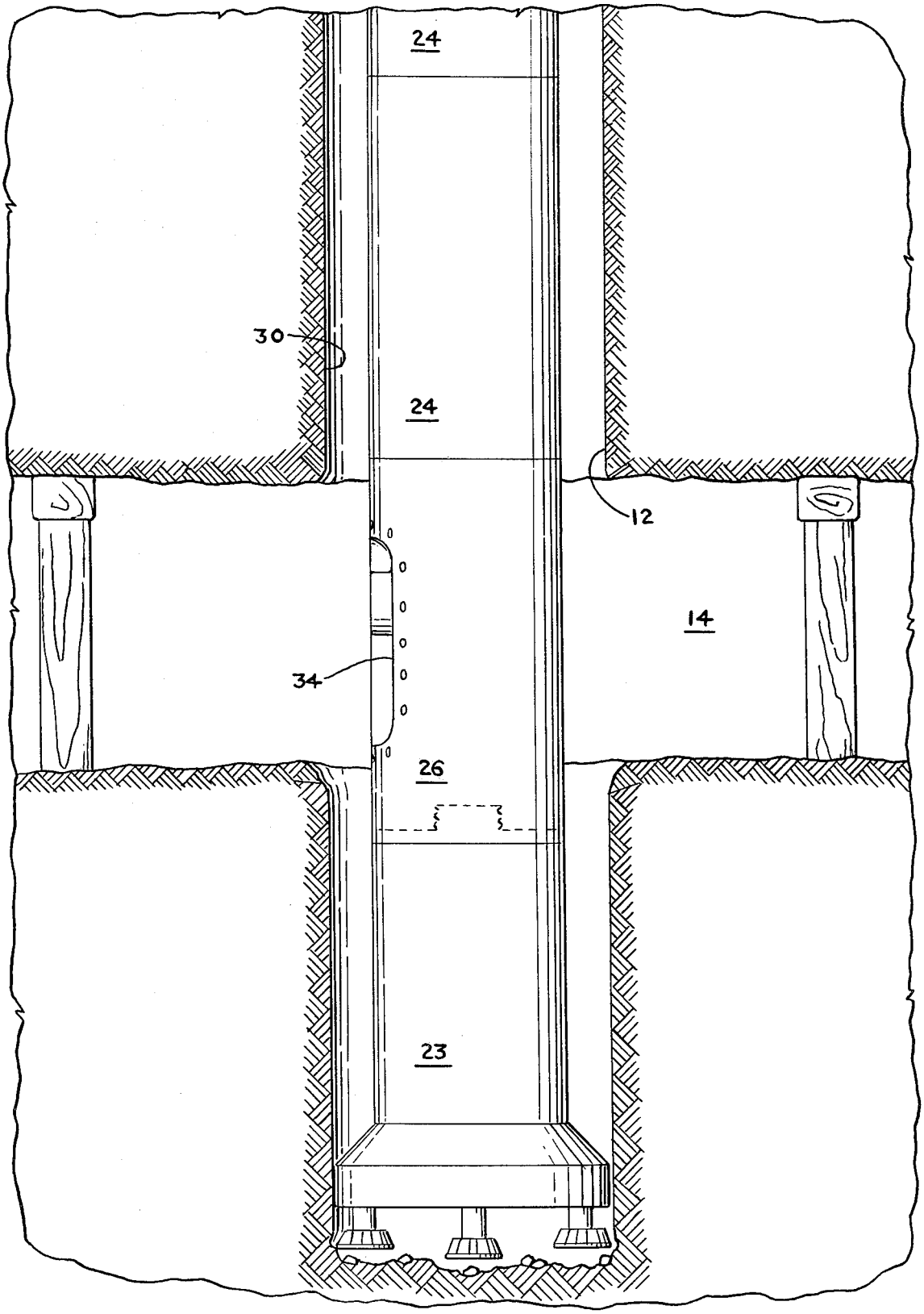
FIG. 3 is a schematic view, partly in cross-section of the drill means, rescue drill pipe section and first drill pipe section of apparatus structured in accordance with the present invention in location in a chamber below ground.

Considering initially FIG. 3, there can be seen a rescue drill pipe section 26 in position for effecting communication with miners who may be trapped at mine site 14. Drill 23 has been utilized to cut an escape hole 12 from the earth's surface to the location of the trapped miners. Communication between area 14 and the earth's surface above area 14 is achieved through the interior of drill pipe sections 24. As noted above, an escape capsule may be dropped down through pipe 24 into rescue drill pipe section 26 to accommodate recovery of the trapped miners.

It should be noted that it has been found that internal flush drill pipe best suits the needs of the present invention because it provides a smooth surface with respect to which the escape capsule may pass freely. Such internal flush drill pipe may be selected from any of the many designs generally known in these arts. However, suitable seals must be provided to insure that the joints between respective pipe sections are air-tight. Such air-tightness is required to permit the drill bore casing to be utilized as the air supply line for drill 23.

Figure 4:
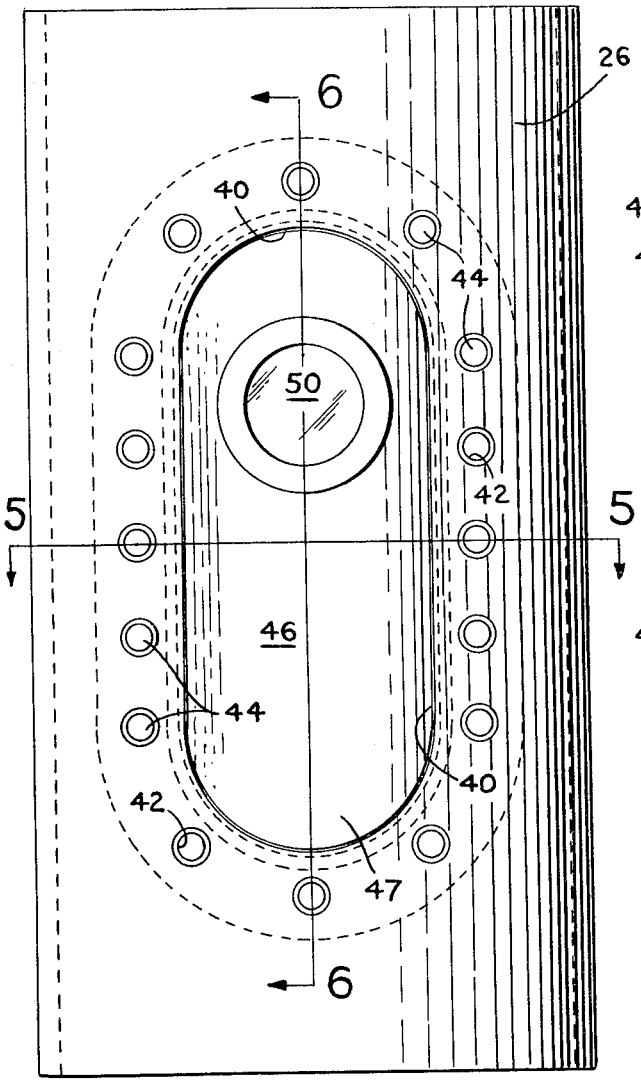
FIG. 4 is a front elevational view of one embodiment of a rescue drill pipe section according to the present invention.
Figure 6:
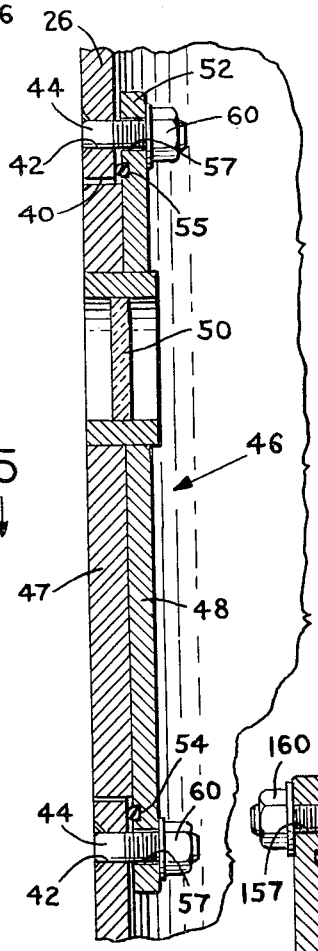
FIG. 6 is a partial cross-sectional view through the plane 6—6 of the FIG. 5.
Figure 5:
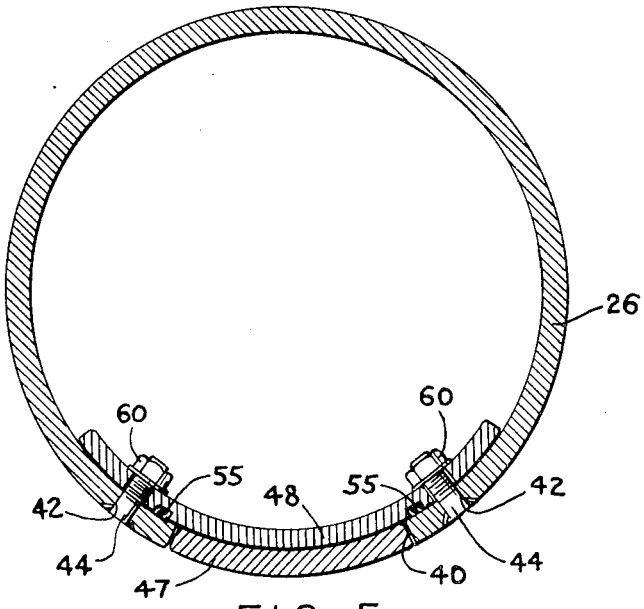
FIG. 5 is a cross-sectional view through the plane 5—5 of FIG. 4.

FIGS. 4, 5 and 6 show partial elevational, and cross-sectional views of rescue drill pipe section 26. Drill pipe section 26 comprises a generally cylindrical steel member having an opening 40 formed therein. Opening 40 defines the access opening through which a miner may pass during a rescue operation. In this regard, opening 40 should be of sufficient size to permit passage therethrough of a person either healthy or injured.

Formed in the wall of section 26 around the edge of opening 40 are a plurality of throughbores 42. Throughbores 42 are designed to accommodate the mounting therein of threaded studs 44. Studs 44 are rigidly secured within bores 42 by means of welding or other suitable method. Further, the securing method must be such as to insure that the joints between studs 44 and bores 42 are air-tight.

At all times other than during actual rescue operations, opening 40 in pipe section 26 is closed by a hatch structure 46 which comprises an outer plate 47, an inner plate 48 and a porthole means 50. Outer plate 47 is a curvilinear element which corresponds in shape and size to the configuration of opening 40. Inner plate 48 is also a curvilinear element, the convex curvature of which is corresponding in curvature to the inner surface of outer plate 47 and of pipe section 26.

Outer plate 47 and inner plate 48 are secured together such as by welding along their edges and the peripheral dimension of inner plate 48 are sufficiently larger than the peripheral dimensions of outer plate 47 such as to define a full peripheral flange 52. Formed in the external surface of flange 52 and spaced outwardly from the peripheral edge of outer plate 47 is a channel 54 in which is mounted a seal 55. Spaced further outwardly in flange 52 are a plurality of throughbores 57 which correspond in location to throughbores 42 formed in pipe section 26. Throughbores 57 accommodate the passage therethrough of studs 44 and permit the provision of nuts 60 thereon to rigidly draw hatch structure 46 through seals 55 against the inner surface of pipe section 26 whereby to create and maintain an air-tight seal therebetween.

Thus, during assembly of the hatch 46 within opening 40 of section 26, outer plate 47 is positioned within opening 40, by so doing studs 44 are passed through throughbores 57 and nuts 60 are thereafter tightened on studs 44 to cause the hatch to become tightly engaged within the surface of pipe section 26.

It should be noted that it may be necessary to provide bores 57 of a diameter which is slightly larger than the diameter of studs 44 so as to accommodate for the alignment requirements established by the radially extending nature of studs 44.

Port 50 may be a standard port construction and mounted within suitable coaxial bores formed in inner and outer plates 48, 47 respectively. It should be noted that in sizing hatch 46 consideration must be given to the structural role which rescue drill pipe section 26 plays during drilling of rescue escape hole 12. In this regard, rescue drill pipe section 26 is the drill pipe section next adjacent drill 23 and must therefore be structurally capable of accommodating all loads which are by necessity transmitted through the drill pipe casing during drilling.

In utilizing the mine rescue equipment of the present invention, the position of the miners is located to the best extent possible and a probe hole is prepared to attempt to make communication with the miners.

Once it is decided that the location for boring the rescue shaft is correct, the crane carrier is positioned and the drilling is commenced with rescue pipe section 26 in position attached to drill 23. Drilling is continued until it is determined that the rescue drill pipe section is in the desired mine area whereupon the drill head is connected and appropriate rigging undertaken to position the rescue cage for being passed downwardly through the drill casings into the rescue drill pipe section.

Thereafter, a man who has been lowered within the drill pipe in the rescue cage can remove nuts 60 from studs 44 thereby permitting hatch 46 to be moved out of the way and access to the mine area to be achieved.

It should be noted that securing means other than the nut and bolt structure shown in the embodiment of FIGS. 4 through 6 may be utilized. Thus, typical port hole hatch locking devices may be utilized, breach lock structure may be utilized or other similar structure which may suit the particular structural necessities of the drill pipe section as may be required.

Figure 7:
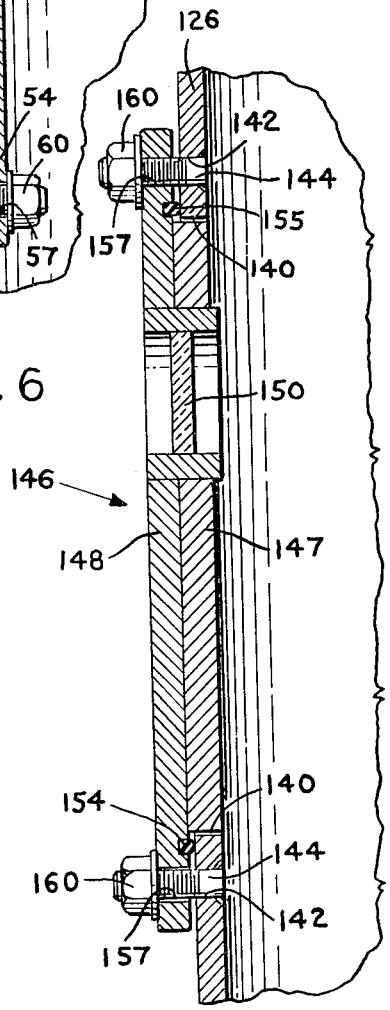
FIG. 7 is a view similar to FIG. 6 but showing an alternative embodiment of hatch structured for utilization with the apparatus of the present invention.

It also may be desired that the hatch be jetissoned away from the rescue drill pipe section 26 rather than being brought inwardly thereof. Thus, in FIG. 7, there is shown a rescue drill pipe section 126 having a hatch means 146 provided therefor. The hatch means incorporates an inner plate 147 and an outer plate 148. The two plates are connected in the same manner as discussed above with respect to inner and outer plates 47, 48 of hatch cover 46. In the embodiment of FIG. 7, inner plate 147 is sized such as to be received within an opening 140 formed in the wall of rescue drill pipe section 126.

Also formed in rescue drill pipe section 126 are a plurality of throughbores 142 in which are rigidly secured threaded studs 144 in an air-tight manner. Studs 144 extend radially outwardly from the surface of rescue drill pipe section 126 and are positioned to be slidably received through a plurality of throughbores 157 formed in outer plate 148.

The outer surface of rescue drill pipe section 126 is provided with a channel formed around the periphery of opening 140 in which channel is mounted a seal means 155. Thus, as cover 146 is positioned over opening 140 so as to cause inner plate 147 to be received within opening 140 the inner surface of outer plate 148 comes in the surface-to-surface contact with the seal 155. Thereafter, nuts 160 are screwed on threaded studs 144 such as to cause the outer plate 148 to be drawn securely against seal 155 thereby establishing an air-tight seal.

It has been found that it may be desirable to make the combination nut and stud 144, 160 an explosive bolt structure such as to permit remote disconnect of hatch 146. This structure might well permit establishing a large diameter of communication between a flooded mine area and the surface so as to permit positioning of a vertical turbine pump and quick dewatering operations.

It will also be recognized by those skilled in the arts that under appropriate circumstances it may be more desirable to not utilize a rescue drill pipe section having a hatch. Rather, connection between the rescue drill pipe section and the drill means may be achieved through the use of an internal coupling whereby to permit disconnect of the drill from the pipe casing. In a situation such as this, access to the trapped miners would be achieved by drilling the hole to the desired depth, lowering a rescue worker through the casing to the level of the drill, disconnecting the drill from the casing and thereafter lifting the casing in such a manner as to permit ingress and egress between the casing and the mine area.

The significant safety benefit of the present invention will be immediately recognized by those having skill in these arts. It is unique to utilize drill pipe as a drill casing for placing a rescue man or team in a tunnel for rescuing trapped miners. Use of the internal flush drill pipe as a protective steel shaftway eliminates the necessity heretofore experienced of removing the drill pipe from the drilled hole and thereafter lining the drill hole with a casing such as to provide access to the area of entrapment of the miners. The time saving involved could very well be 24 hours which often times, in situations such as these, may be critical.

The foregoing constitutes a unique approach to mine rescue. Its benefits and the step forward in the art which it represents will be immediately evident to those skilled in the arts. It will further recognized that many modifications and variations may be made to the disclosed embodiments without departing from the spirit and scope of the invention.

What is claimed is:

1. Apparatus for gaining access to an underground chamber, comprising:

drill means for drilling a hole in the earth from the earth's surface to said chamber, said drill means comprising a pneumatically operated drill;

drill pipe casing means extending from said drill means through said hole to the surface of the earth, the interior of said drill pipe casing means defining a personnel passage and said drill pipe casing means comprising an air-tight pipe casing such that said drill pipe casing means defines the compressed air supply line for providing operating air to said drill means; and means for placing said personnel passage in communication with said chamber to permit passage of personnel between said personnel passage and said chamber.

2. Apparatus according to claim 1 wherein said means for communicating said personnel passage with said chamber comprises an opening formed in said pipe casing means.

3. Apparatus according to claim 2 including hatch means for closing said opening in said pipe casing.

4. Apparatus according to claim 3 wherein said hatch means is ridigly securable to said pipe casing and further including seal means for establishing and maintaining an air-tight seal around the joint between said hatch means and the structure of said casing adjacent said opening.

5. Apparatus according to claim 3 wherein said hatch means includes an inner plate and an outer plate rigidly secured together, said inner plate corresponding substantially in size and configuration to said opening.

6. Apparatus according to claim 3 wherein said hatch means includes an inner plate and an outer plate and wherein said outer plate corresponds substantially in configuration and size to said opening.

7. Apparatus according to claim 3 including means for releasably securing hatch means to said pipe casing for closing said opening.

8. Apparatus according to claim 7 wherein said means for releasably securing said hatch means comprises explosive bolt means.

9. Apparatus according to claim 4 including a porthole means formed in said hatch means.

10. Drill pipe casing section comprising a generally elongated cylindrical casing section;

means formed on the end of said casing section for securing said casing section to the next adjacent sections;

an opening formed in the wall of said casing section; and hatch means rigidly secured to said casing section for closing said opening, said hatch means including an inner plate and an outer plate wherein said inner plate corresponds substantially in size and configuration to said opening formed in the wall of said casing section, said inner plate and said outer plate cooperating to define an inner surface and an outer surface of said hatch means and wherein said inner surface comprises a curved surface corresponding in curvature to the inner surface of said casing means, said inner surface of said hatch means and said inner surface of said casing means cooperating to define a generally continuous cylindrical surface.

11. Drill pipe casing section comprising a generally elongated cylindrical casing section;

means formed on the end of said casing section for securing said casing section to the next adjacent sections;

an opening formed in the wall of said casing section; and hatch means rigidly secured to said casing section for closing said opening, said hatch means including an inner plate and an outer plate, said outer plate conforming substantially in size and configuration to said opening formed in said wall of said casing section, said hatch means including an inner surface and an outer surface and wherein said inner surface comprises a curved surface corresponding in curvature to the inner surface of said casing means, said inner surface of said hatch means and said inner surface of said casing means cooperating to define a generally continuous cylindrical surface.

* * * * *